US008038419B2

(12) United States Patent
Schmidt et al.

(10) Patent No.: US 8,038,419 B2
(45) Date of Patent: Oct. 18, 2011

(54) CONTROLLABLE COOLANT PUMP

(75) Inventors: Eugen Schmidt, Merbelsrod (DE); Franz Pawellek, Lautertal (DE)

(73) Assignee: Geräte- und Pumpenbau GmbH Dr. Eugen Schmidt, Merbelsrod (DE)

( * ) Notice: Subject to any disclaimer, the term of this patent is extended or adjusted under 35 U.S.C. 154(b) by 910 days.

(21) Appl. No.: 11/885,010

(22) PCT Filed: Aug. 11, 2006

(86) PCT No.: PCT/DE2006/001405

§ 371 (c)(1),
(2), (4) Date: Sep. 6, 2007

(87) PCT Pub. No.: WO2007/071217

PCT Pub. Date: Jun. 28, 2007

(65) Prior Publication Data

US 2008/0317609 A1 Dec. 25, 2008

(30) Foreign Application Priority Data

Dec. 23, 2005 (DE) ..... 10 2005 062 200

(51) Int. Cl.
*F04B 35/04* (2006.01)

(52) U.S. Cl. ..... 417/423.1; 417/423.14; 123/41.09

(58) Field of Classification Search ..... 417/423.1, 417/423.14, 307; 123/41.09
See application file for complete search history.

(56) References Cited

U.S. PATENT DOCUMENTS

| | | | | |
|---|---|---|---|---|
| 2,824,520 | A * | 2/1958 | Bartels | 417/423.7 |
| 4,828,455 | A | 5/1989 | Kinbara et al. | |
| 7,334,543 | B2 * | 2/2008 | Pawellek | 123/41.1 |
| 2002/0012583 | A1 | 1/2002 | Hesse | |
| 2006/0216166 | A1 | 9/2006 | Pawellek | |

FOREIGN PATENT DOCUMENTS

| | | | |
|---|---|---|---|
| DE | 881 306 | C | 6/1953 |
| DE | 37 06 970 | A1 | 9/1988 |
| DE | 197 01 993 | A1 | 7/1998 |
| DE | 197 52 372 | A1 | 5/1999 |
| DE | 199 01 123 | | 7/2000 |
| DE | 100 57 098 | C1 | 3/2002 |
| DE | 102 35 721 | A1 | 2/2004 |
| DE | 103 14 526 | A1 | 10/2004 |
| JP | 62 210287 | A | 9/1987 |

OTHER PUBLICATIONS

International Serch Report, Jan. 15, 2007.

"Die Kreiselpumpen" [Impeller-driven pumps] by C. Pfleiderer, Springer-Verlag, 4th Edition (1955), pp. 421-422 (with English translation of pertinent portions).

* cited by examiner

*Primary Examiner* — Devon C Kramer
*Assistant Examiner* — Peter J Bertheaud
(74) *Attorney, Agent, or Firm* — Collard & Roe, P.C.

(57) ABSTRACT

A controllable coolant pump for internal combustion engines driven by torque transmission elements has a pump housing, a driven shaft mounted in the pump housing, an impeller wheel arranged fixedly in terms of rotation on a free, flow-side end of the shaft, and a pressure-activated valve slide having an outer cylinder covering the outflow region of the impeller wheel in a variable manner. The valve slide is of annular configuration and is arranged on piston rods mounted displaceably in the pump housing. An annular piston mounted in an annular groove in the pump housing and movable in a defined manner in the annular groove via excess pressure or vacuum is arranged on the piston rods in a manner lying opposite the valve slide.

7 Claims, 4 Drawing Sheets

CONTROLLABLE COOLANT PUMP

CROSS REFERENCE TO RELATED APPLICATIONS

Applicants claim priority under 35 U.S.C. §119 of German Application No. 10 2005 062 200.3 filed Dec. 23, 2005. Applicants also claim priority under 35 U.S.C. §365 of PCT/DE2006/001405 filed Aug. 11, 2006. The international application under PCT article 21(2) was not published in English.

BACKGROUND OF THE INVENTION

1. Field of the Invention

The invention relates to a controllable coolant pump driven by way of a belt pulley.

2. Description of Related Art

In the state of the art, controllable coolant pumps for internal combustion engines are previously described, which are driven by the crankshaft of the internal combustion engine by way of a belt pulley, and in which the impeller wheel is driven by the pump shaft in switchable manner, for example in connection with a friction pairing.

The applicant presented a proven controllable coolant pump in the patent DE 100 57 098 C1, in which a magnetic coil is disposed in the pump housing, in stationary manner, which coil can enter into an action connection with an anchor disk that is disposed on the drive shaft so as to rotate with it, but is displaceable under spring force, provided with a friction coating on the impeller wheel side, in such a manner that when the magnetic field is shut off, the impeller wheel that is disposed on the drive shaft so as to rotate is entrained by the anchor disk as a result of the spring press-down pressure.

Since, in the case of this construction, the entrainment friction moment is greatly limited by the magnetic construction space that is available, this solution was developed further in systematic manner.

The application DE 102 35 721 A1 that builds on this solution describes a controllable coolant pump which has been optimized in terms of construction space, having a drive torque that can be transferred from the friction disk of the magnetic coupling to the impeller wheel, which torque is clearly increased.

This increased drive torque is brought about by means of increasing the press-down force, which results from the fact that a partial vacuum that supports the press-down force is built up between the friction disk and the impeller wheel, by means of an inflow ring and an outflow ring for the cooling medium, and, at the same time, the friction disk has the pressure of the cooling medium applied to it during operation, by means of overflow openings on the coupling side.

Both the cooling power and the drive power of the coolant pump can be varied by means of the two-point regulation that can be implemented with such coolant pumps.

However, optimal regulation of the drive power or cooling power of coolant pumps for motor vehicles is supposed to make it possible to avoid compulsory cooling that starts immediately when the engine is started, causing the warm-up phase of the engine, with all the disadvantages that occur during this phase, such as increased friction losses, increased emission values, and increased fuel consumption, to be clearly reduced.

In order to now allow such faster engine warm-up, with the advantages that result from it, the drive of the coolant pump was uncoupled during cold start of the engine, with the aforementioned constructions.

Once the engine reached its operating temperature, the friction coupling, with the wear problems inherent to this coupling construction, as a result of its function, was activated, and the drive of the coolant pump was turned on.

In this connection, a large amount of cold coolant was now pumped into the engine, which had heated up to operating temperature, so that the engine immediately cooled down greatly.

When this happened, however, the desired advantages of rapid warm-up of the engine were partially compensated again.

When larger coolant pumps were turned on again, great torques furthermore had to be overcome, because of the required mass acceleration, and this necessarily resulted in great component stress. A solution was previously described in U.S. Pat. No. 4,828,455, in which it was possible to change the active impeller width of the impeller wheel by means of a slit, axially movable disk.

A controllable coolant pump having an open impeller wheel and an adjustable slide having a slit, axially movable base, with which the effective impeller width of the impeller wheel can be varied by means of electrical, hydraulic, or pneumatically activated displacement of the slide is also known from DE 199 01 123 A1.

One of the significant disadvantages of the two aforementioned constructions is, however, that slit slides can only be used in connection with simply curved, open vane wheels.

However, such simply curved vane wheels necessarily have a low degree of effectiveness.

Another construction of a slide was presented by the applicant in DE 103 14 526 A1. This is a valve slide that is electromagnetically activated and works in the suction region of a coolant pump.

In the case of large pump units in systems technology and power technology, other constructions of valve slides are used (cf. "Die Kreiselpumpen" [Impeller-driven pumps] by C. Pfleiderer, Springer-Verlag, $4^{th}$ edition (1955), p. 422).

These constructions, referred to as split slides, are axially displaceable valve slides disposed concentric to the impeller wheel, which are supposed to prevent exit of the fluid from the impeller wheel into the pressure spiral in the closed position, and are used to block off the volume stream.

In DE 881 306 C, for example, such an axially movable, spring-loaded, hydraulically adjustable split slide that works in the pressure region is previously described, which is able to greatly restrict the transport volume stream under a spring effect, while taking advantage of the differential pressure of the wheel side space.

However, these solutions of impeller-driven pump technology are not suitable for use as a coolant pump in motor vehicle technology, since, among other things, the slide closes as a result of the spring effect, for example, so that a failure of the control necessarily also means a failure of the coolant pump, and continued operation of the coolant pump after failure of the control (fail-safe) cannot be guaranteed.

Furthermore, in the case of this construction, the guides are always exposed to the operating medium, with the unavoidable contaminant load of the cooling medium, such as molding sand, metal particles, and the like, from the production process, for example, or resulting from wear, so that dirt particles that penetrate into the guides necessarily lead to jamming of the slide.

Furthermore, no "zero leakage" can be implemented with these slides previously described in the state of the art, in the closed state.

In the course of the increasing optimization of internal combustion engines with regard to emissions and fuel consumption, however, it is becoming increasingly important to bring the engine to operating temperature as quickly as possible after a cold start, in order to minimize friction losses, on the one hand (with an increasing oil temperature, the viscosity of the oil decreases, thereby decreasing the friction on all oil-lubricated components), and reducing the emission values (since the catalytic converters only go into effect after the so-called "starting temperature", the time period until this temperature is reached significantly influences the exhaust gas emissions), in order to thereby simultaneously reduce the fuel consumption.

Test series in engine development have shown that a very effective measure for warming the engine is that of "standing water" or "zero leakage" during the cold-start phase.

In this connection, coolant should by no means flow through the cylinder head during the cold-start phase, in order to bring the exhaust gas temperature to the desired level as quickly as possible.

Leakage gas flows of less than 0.5 l/h ("zero leakage") are desired by vehicle manufacturers.

Studies concerning the fuel consumption of internal combustion engines in motor vehicles have also shown that about 3 to 5% fuel can be saved by means of consistent thermal management, in other words those measures that result in optimal operation of an internal combustion engine in terms of energy and thermomechanics.

Therefore, ever more precise regulation of the coolant throughput as a function of the temperature of the coolant being passed through is absolutely necessary, taking these aspects into account.

SUMMARY OF THE INVENTION

This goal is supposed to be achieved with the least possible expenditure of materials and costs.

The invention is therefore based on the task of developing a driven, controllable coolant pump for internal combustion engines, which avoids the aforementioned disadvantages of the state of the art, guarantees continued operation of the coolant pump (fail-safe) even in the case of failure of the control, is characterized by a high degree of effectiveness, a very compact, simple, robust construction, and which guarantees a high level of operational safety and reliability even in the case of operating medium charged with a load of dirt, allows active control of the coolant transport amount, in order to guarantee optimal warm-up of the engine, by means of "zero leakage," on the one hand, and to influence the engine temperature in ongoing operation so precisely, on the other hand, that not only the emission of pollutants but also the friction losses and the fuel consumption can be clearly reduced in the entire working range of the engine.

This task is accomplished by means of a controllable coolant pump in accordance with the invention.

The controllable coolant pump according to the invention, having a pump housing (1), a driven shaft (2) mounted in the pump housing (1), an impeller wheel (3) disposed on a free, flow-side end of this shaft (2), so as to rotate with it, and a pressure-activated valve slide (4) having an outer cylinder (5) that variably covers the outflow region of the impeller wheel (3), is characterized in that the valve slide (4) is configured in ring shape, whereby several piston rods (6) are disposed on the valve slide (4); several bores (7) are made in the pump housing (1), parallel to the shaft (2), uniformly distributed over the circumference of the valve slide (4), assigned to the piston rods (6) disposed on the valve slide (4); at the valve slide end of these bores, seal accommodations (8) are situated in the pump housing (1), in which rod seals (9) are disposed, whereby at the opposite end of the bores (7), a ring groove (10) is disposed on the pump housing (1), which groove connects the bores (7) with one another; and piston guides (11) are disposed in the bores (7), in which guides the piston rods (6) disposed on the valve slide (4) are mounted so as to be axially displaceable, whereby the piston rods (6) disposed in the piston guides (11) are connected with one another with their ring groove side ends, by means of a ring piston (12), whereby the latter is mounted to be displaceable in the ring groove (10); on the ring groove side, spring chambers (13) are made in the pump housing (1), between the bores (7), uniformly distributed over the circumference of the ring piston (12), in which chambers pressure springs (14) braced against the ring piston (12) are disposed.

This arrangement, according to the invention, of a ring-shaped valve slide (4) disposed on piston rods (6) and guided in the pump housing (1) in sealed piston guides (11), which can be activated by way of a ring piston (12), is a very compact, simple, and robust construction, which guarantees a high level of operational security and reliability even in the case of operating medium charged with a load of dirt.

The face of the ring piston (12) that lies opposite the piston rods (6) is provided with a ring crosspiece (15), according to the invention, on which a rolled folded covering (16) is disposed, which is attached by means of a clamping lid (18) braced against the pump housing (1) with bracing elements (17). This rolled folded covering (16) guarantees simple and reliable sealing of the ring piston (12) with regard to the ring groove (10).

It is furthermore essential to the invention that one or more pressure connector bore(s) (20) for pressure activation of the valve slide (4) is/are disposed in the pump housing (1), which bore(s) open(s) into a pressure connector fitting (19) disposed on the pump housing (1).

In this connection, it is characteristic, on the one hand, that the pressure connector bore(s) (20) open(s) into the ring chamber (32) formed by the ring groove (10) and the ring piston (12), on the pressure spring side of the ring piston (12). In this way, a defined displacement of the valve slide (4), and thereby an active regulation of the coolant transport amount, can be brought about by means of a partial vacuum, which can be varied in defined manner, applied to the pressure connector fitting (19). In connection with the pressure springs (14) disposed between the pump housing (1) and the ring piston (12), according to the invention, continued operation (fail-safe) of the coolant pump according to the invention is guaranteed even in case of failure of the control.

According to the invention, in the case of this construction, pressure equalization bores (21) are disposed in the clamping lid (18), in the working region of the rolled folded covering (16), which bores stand in connection with the outside region. By way of these pressure equalization bores (21), pressure equalization in the seal chamber (26) between the clamping lid (18) and the rolled folded covering (16) disposed on the ring piston (12) is guaranteed in the case of a displacement of the ring piston (12).

However, it is also characteristic, on the other hand, that the pressure connector bore (20) opens into the seal chamber (26) formed by the clamping lid (18) and the rolled folded covering (16) disposed on the ring piston (12), on the clamping lid side of the rolled folded covering (16) disposed on the ring piston (12). In this construction of the solution according to the invention, a defined displacement of the valve slide (4), and thereby an active control of the coolant transport amount, can be brought about by means of a pneumatic or hydraulic pressure, which can be varied in defined manner, applied to the pressure connector fitting (19). In connection with the pressure springs (14) disposed between the pump housing (1) and the ring piston (12), according to the invention, continued operation (fail-safe) of the coolant pump according to the invention is guaranteed even in case of failure of the control, in the case of this construction, as well.

It is also essential to the invention, in the case of this construction, that pressure equalization bores (21) that stand in connection with the outside region are disposed in the region of the ring groove (10) in the pump housing (1), on the valve slide side of the ring piston (12). Pressure equalization in the ring chamber (32) between the ring groove (10) and the ring piston (12) is guaranteed by way of these pressure equalization bores (21), in the case of displacement of the ring piston (12).

It is furthermore in accordance with the invention that an elastomer bypass seal (23) is disposed on the piston rod side outside edge (22) of the valve slide (4), which seal cannot contribute to jamming of the valve slide during the slide stroke, and, in the closed position of the valve slide (4) closes off the ring gap (25) between the pump housing (1) and the valve slide (4).

At the same time, in this closed position (the end position when the valve slide is in the "CLOSED" position), the valve slide (4) lies against a sealing surface (24) of the pump housing (1), so that even the smallest leakages are prevented in "CLOSED" position of the valve slide.

"Zero leakage" and therefore optimal warm-up of the engine are guaranteed by means of the arrangement according to the invention, at a high degree of effectiveness of the pump. Furthermore, after warm-up of the engine, the engine temperature can be influenced in ongoing operation, so precisely that not only the emission of pollutants but also the friction losses and the fuel consumption are clearly reduced, in the entire working range of the engine.

BRIEF DESCRIPTION OF THE DRAWINGS

Additional details and characteristics of the invention are evident from the following description of the solution according to the invention, in connection with the drawings of exemplary embodiments.

These show.

DETAILED DESCRIPTION OF THE PREFERRED EMBODIMENTS

Figure 1:
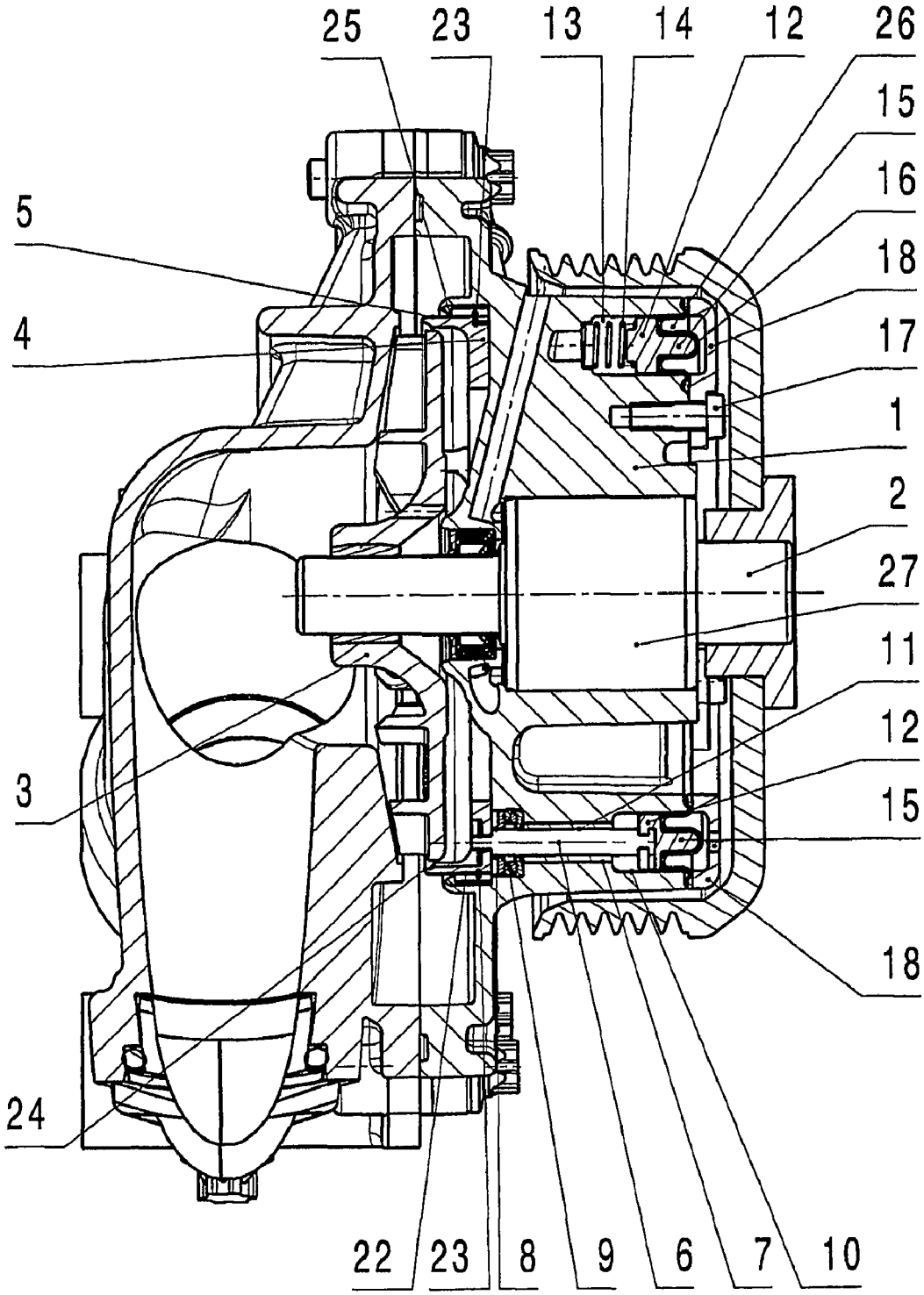
FIG. 1: a controllable coolant pump for regulating partial vacuum, according to the invention, in section, with the valve slide set in its rear end position ("OPEN")

FIG. 1 shows one of the possible constructions of the controllable coolant pump according to the invention, in section, in a side view, with the position of the valve slide in its rear end position ("OPEN").

This construction can be used in connection with regulating partial vacuum.

A driven shaft 2 is mounted in a pump bearing 27 in a pump housing 1. An impeller wheel 3 is disposed on the free, flow-side end of the shaft 2. Adjacent to this impeller wheel 3, a pressure-activated, ring-shaped valve slide 4 having an outer cylinder 5 that variably covers the outflow region of the impeller wheel 3 is displaceably disposed in the pump housing 1. Several piston rods 6 are disposed on the valve slide 4. Several bores 7 are made in the pump housing 1, parallel to the shaft 2, uniformly distributed over the circumference of the valve slide 4, assigned to the piston rods 6 disposed on the valve slide 4; at the valve slide end of these bores, seal accommodations 8 are situated in the pump housing 1, in which rod seals 9 are disposed, whereby at the opposite end of the bores 7, a ring groove 10 is disposed on the pump housing 1, which groove connects the bores 7 with one another. Piston guides 11 are disposed in the bores 7, in which guides the piston rods 6 disposed on the valve slide 4 are mounted so as to be axially displaceable.

These piston rods 6 disposed in the piston guides 11 are connected with one another with their ring groove side ends, by means of a ring piston 12.

This ring piston 12 is mounted to be displaceable in the ring groove 10. On the ring groove side, spring chambers 13 are made in the pump housing 1, between the bores 7, uniformly distributed over the circumference of the ring piston 12, in which chambers pressure springs 14 braced against the ring piston 12 are disposed.

The arrangement according to the invention, of a ring-shaped valve slide 4 disposed on piston rods 6 and guided in sealed piston guides 11 in the pump housing 1, which can be activated by way of a ring piston 12, represents a very compact, simple, and robust construction that guarantees a high level of operational safety and reliability even in the case of operating medium charged with a load of dirt.

The face of the ring piston 12 that lies opposite the piston rods 6 is provided, according to the invention, with a ring crosspiece on which a rolled folded covering 16 is disposed, which is attached by means of a clamping lid 18 braced against the pump housing 1 with bracing elements 17. This rolled folded covering guarantees simple and reliable sealing of the ring piston 12 with regard to the ring groove 10.

An elastomer bypass seal 23 is disposed on the piston rod side outer edge 22 of the valve slide 4; this seal cannot contribute to jamming of the valve slide during the slide stroke.

Figure 2:
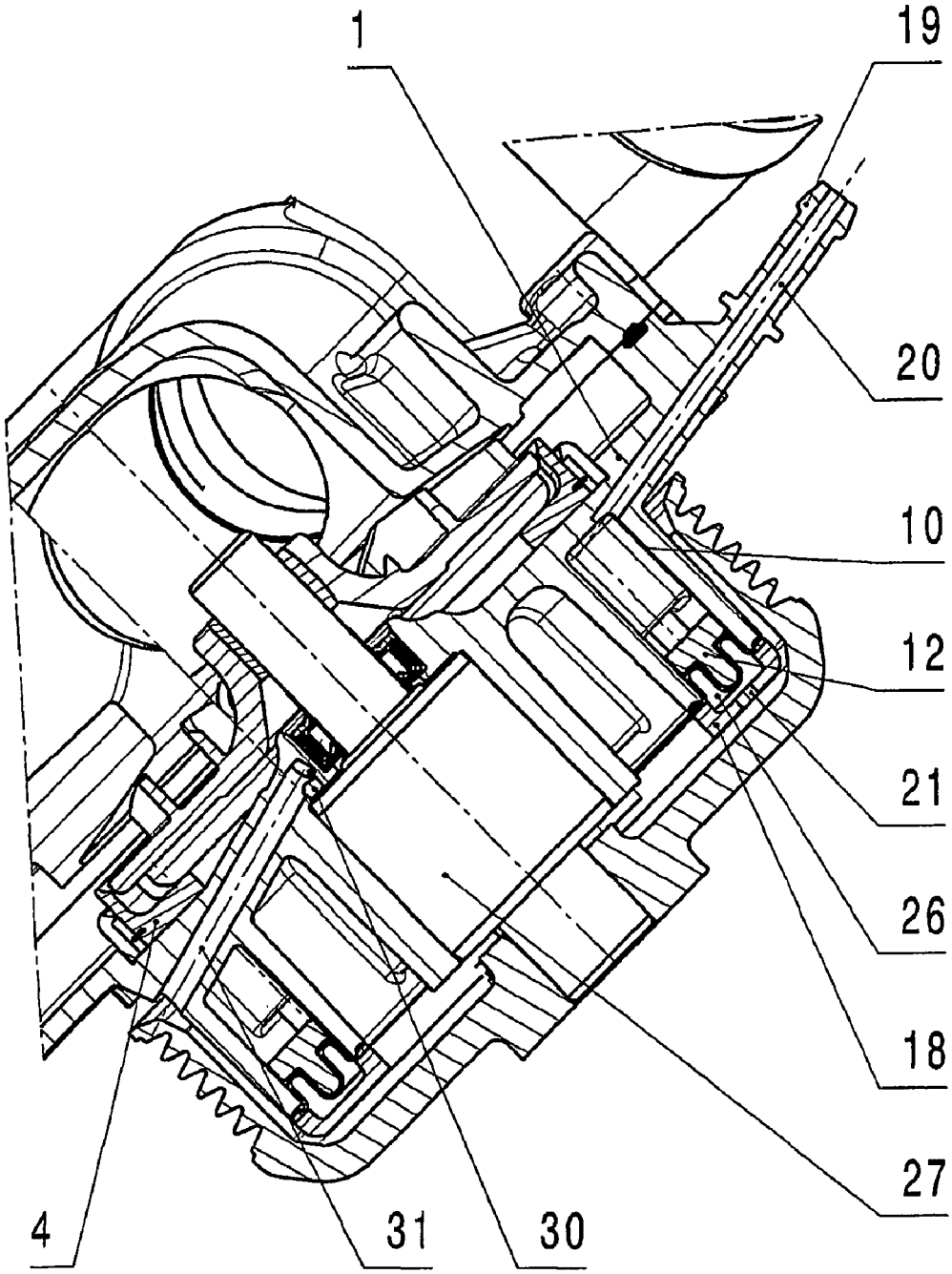
FIG. 2: the controllable coolant pump for regulating partial vacuum, according to the invention, according to FIG. 1, in a side view, in another section, with the valve slide set in its rear end position ("OPEN")

FIG. 2 now shows the controllable coolant pump for regulating partial vacuum, according to the invention, as shown in FIG. 1, in a side view, in a different sectional representation, with the position of the slide valve again in its rearmost end position ("OPEN").

In this construction, a pressure connector fitting 19 having a pressure connector bore 20 is disposed on the pump housing 1, according to the invention, for pressure activation of the valve slide 4. The pressure connector bore 20 opens into the ring groove 10, on the pressure spring side of the ring piston 12. In this way, a defined displacement of the valve slide 4, and thereby active control of the coolant transport amount, can be brought about by means of a partial vacuum, which can be varied in defined manner, applied to the pressure connector fitting 19. In connection with the pressure springs 14 shown in FIG. 1, disposed between the pump housing 1 and the ring piston 12, according to the invention, continued operation (fail-safe) of the coolant pump according to the invention is guaranteed even in case of failure of the partial vacuum control, by means of the "OPEN" slide position that is compulsory in the end position of the spring.

According to the invention, pressure equalization bores 21 that stand in connection with the outside region are disposed in the clamping lid 18, in the working region of the rolled folded covering 16. Pressure equalization in the seal chamber 26 between the clamping lid 18 and the rolled folded covering 16 is guaranteed by way of these pressure equalization bores 21, in the case of displacement of the ring piston 12.

Furthermore, on the pump wheel side of the bearing seat, a leakage bore 31 is disposed in the pump housing 1, which bore connects a leakage entry 30 disposed on the face side of the pump bearing 27 with the outside region.

Figure 3:
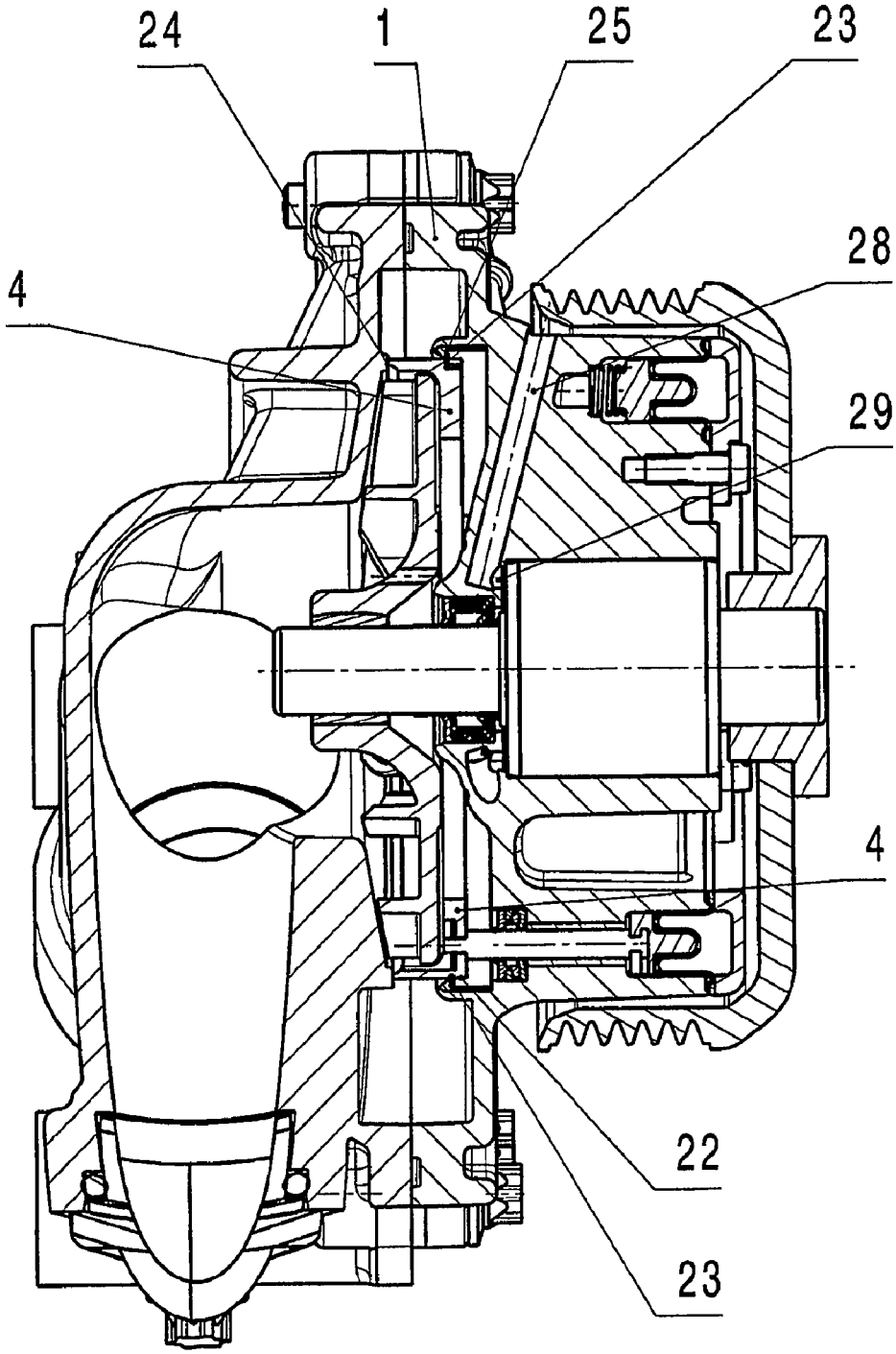
FIG. 3: the controllable coolant pump for regulating partial vacuum, according to the invention, in a side view, in section analogous to FIG. 1, but with the valve slide set in its front end position ("CLOSED")

FIG. 3 now shows the controllable coolant pump for regulating partial vacuum, according to the invention, in a side view, analogous to FIG. 1, but with the position of the valve slide in its front end position ("CLOSED").

In this closed position of the valve slide 4, the valve slide 4 lies against a sealing surface 24 of the pump housing 1 and, at the same time, closes off the ring gap 25 between the pump housing 1 and the valve slide 4, with the elastomer bypass seal 23 disposed on the piston rod side outer edge 22 of the valve slide 4, so that even the smallest leakages are prevented in the "CLOSED" position of the valve slide.

By means of this arrangement, according to the invention, "zero leakage" and thus optimal warm-up of the engine are guaranteed, at a high degree of effectiveness of the pump, whereby it is possible, by means of the arrangement according to the invention, to influence the engine temperature in ongoing operation, after the engine has warmed up, so precisely that not only the emission of pollutants but also the friction losses and the fuel consumption are clearly reduced in the entire working range of the engine.

On the pump wheel side of the bearing seat, a ventilation bore 28 is disposed in the pump housing 1 in this construction, which bore connects a ventilation inlet 29 disposed on the face side of the pump bearing 27 in the pump housing 1 with the outside region.

Figure 4:
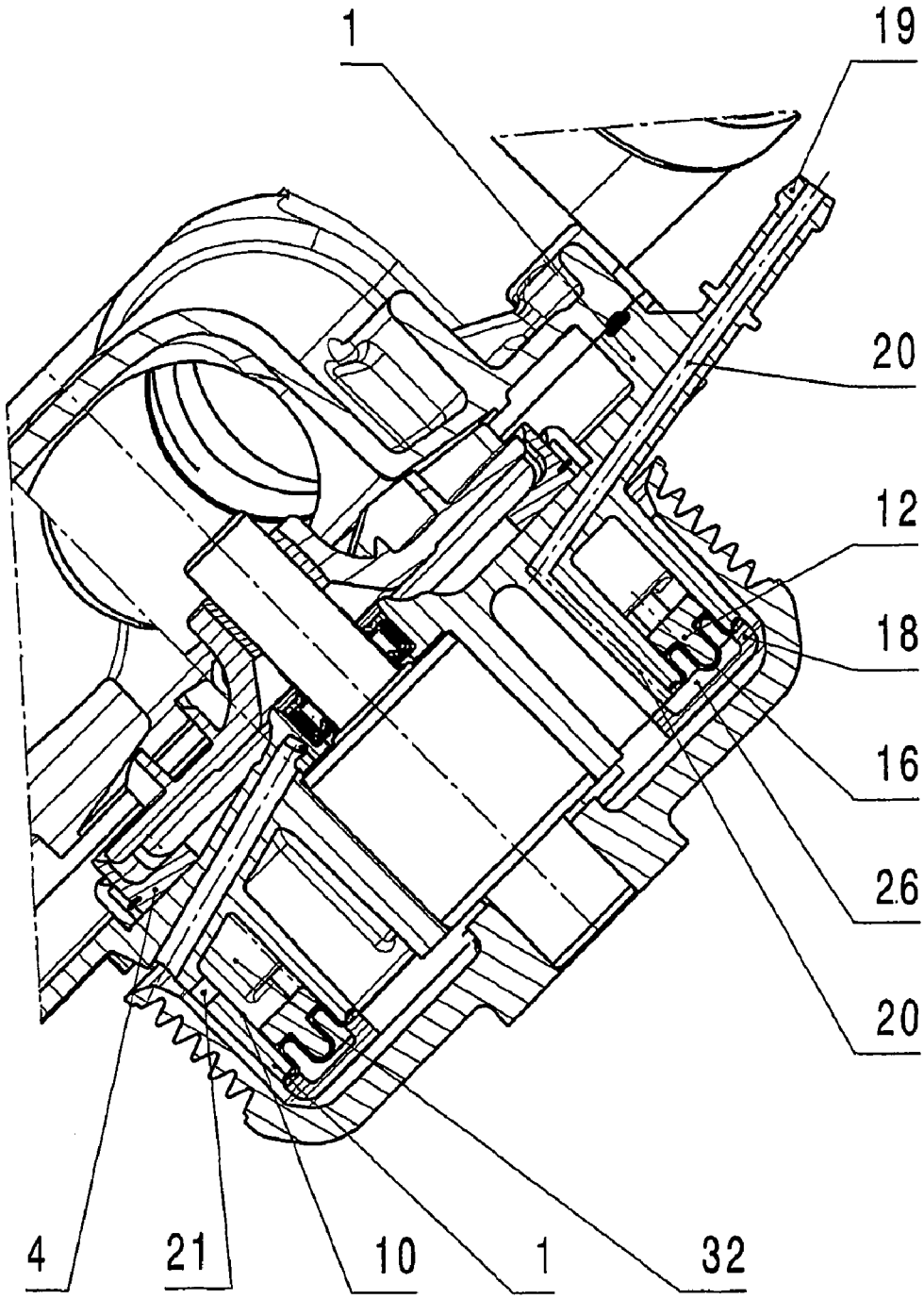
FIG. 4: a controllable coolant pump for regulating partial vacuum, according to the invention, in a side view, in section, with the valve slide set in its rear end position ("OPEN").

Another construction of the controllable coolant pump according to the invention is shown in FIG. 4 in a side view, in section, with the position of the valve slide in its rearmost "OPEN" end position.

This construction can be used in conjunction with a hydraulic or pneumatic excess pressure control.

In this construction, as well, a pressure connector fitting 19 is disposed on the pump housing 1, according to the invention. However, the pressure connector bore 20 now opens on the clamping lid side of the rolled folded covering 16 disposed on the ring piston 12, into the seal chamber 26 formed by the clamping lid 18 and the rolled folded covering 16 disposed on the ring piston 12.

In this construction of the solution according to the invention, a defined displacement of the valve slide 4, and thereby active control of the coolant transport amount, can be brought about by means of a pneumatic or hydraulic excess pressure, which can be varied in defined manner, applied to the pressure connector fitting 19.

In conjunction with the pressure springs 14 shown in FIG. 1, disposed, according to the invention, between the pump housing 1 and the ring piston 12, continued operation of the coolant pump (fail-safe) according to the invention is guaranteed in this construction, as well, even in the case of failure of the control.

According to the invention, in the case of this construction, pressure equalization bores 21 that stand in connection with the outside region are disposed on the valve slide side of the ring piston 12, in the region of the ring groove 10 in the pump housing 1. In the case of displacement of the ring piston 12, pressure equalization in the ring chamber 32 between the ring groove 10 and the ring piston 12 is guaranteed by way of these pressure equalization bores 21.

REFERENCE SYMBOL LIST

1 pump housing
2 shaft
3 impeller wheel
4 valve slide
5 outer cylinder
6 piston rods
7 bores
8 seal accommodations
9 rod seals
10 ring groove
11 piston guides
12 ring piston
13 spring chambers
14 pressure spring
15 ring crosspiece
16 rolled folded covering
17 bracing elements
18 clamping lid
19 pressure connector fitting
20 pressure connector bore
21 pressure equalization bore
22 outer edge
23 elastomer bypass seal
24 sealing surface
25 ring gap
26 seal chamber
27 pump bearing
28 ventilation bore
29 ventilation inlet
30 leakage entry
31 leakage bore
32 ring chamber

The invention claimed is:

1. A controllable coolant pump comprising:

(a) a pump housing comprising a plurality of bores, a plurality of piston guides disposed in the bores, a plurality of spring chambers disposed between the bores, and a plurality of seal accommodations;

(b) a driven shaft mounted in the pump housing, said shaft having a free, flow-side end;

(c) an impeller wheel disposed on said free, flow-side end so as to rotate with said shaft, said impeller wheel having an outflow region;

(d) a pressure-activated annular valve slide having an outer cylinder variably covering the outflow region of the impeller wheel; and (e) a plurality of piston rods disposed on the valve slide and mounted in the piston guides so as to be axially displaceable;

wherein the bores are uniformly distributed circumferentially in the pump housing parallel to the shaft and associated with the piston rods disposed on the valve slide, each bore having a first end toward the valve slide and a second end opposite to the first end;

wherein the seal accommodations are situated in the pump housing at the first end and a plurality of rod seals are disposed in the seal accommodations;

wherein an annular groove is disposed in the pump housing at the second end, said annular groove connecting the bores with each other;

wherein an annular piston mounted to be displaceable in the annular groove connects the piston rods with each other at piston rod ends of the piston rods towards the annular groove;

wherein a plurality of chamber pressure springs are disposed in the spring chambers and braced against the annular piston in a uniform distribution circumferentially over the annular piston;

wherein an annular crosspiece is disposed on a top side of the annular piston opposite to the piston rods and a rolled folded covering is fastened to the annular crosspiece via a clamping lid braced against the pump housing via bracing elements;

wherein at least one pressure connector bore for pressure activation of the valve slide is disposed in the pump housing, said at least one bore opening into a pressure connector fitting disposed on the pump housing; and wherein an elastomer bypass seal is disposed on an outer edge of the valve slide, said elastomer bypass seal in a closed position closing an annular gap between the pump housing and the valve slide when the valve slide is brought into contact with a sealing surface of the pump housing.

2. The controllable coolant pump according to claim 1, wherein the at least one pressure connector bore opens into an annular chamber formed by the annular groove and the annular piston on a pressure spring side of the annular piston.

3. The controllable coolant pump according to claim 2, wherein pressure equalization bores are disposed in the clamping lid in a working region of the rolled folded covering to connect with an outside region.

4. The controllable coolant pump according to claim 1, wherein the at least one pressure connector bore opens into a seal chamber formed by the clamping lid and the rolled folded covering disposed on the annular piston on a clamping lid side of the rolled folded covering disposed on the annular piston.

5. The controllable coolant pump according to claim 4, wherein pressure equalization bores are disposed in the pump housing on a valve slide side of a working region of the annular piston in an area of the annular groove to connect with an outside region.

6. The controllable coolant pump according to claim 1, further comprising a ventilation bore disposed in the pump housing on an impeller side of a bearing seating, wherein said ventilation bore connects a ventilation inlet disposed in the pump housing on a front side of a pump bearing with an outside region.

7. The controllable coolant pump according to claim 1, further comprising a leakage bore disposed in the pump housing on an impeller side of a bearing seating, wherein said leakage bore connects a leakage entry disposed in the pump housing on a front side of a pump bearing with an outside region.

* * * * *